United States Patent [19]

Kimpara et al.

[11] 4,428,726

[45] Jan. 31, 1984

[54] BURNER APPARATUS

[75] Inventors: Nobuyuki Kimpara, Tenri; Hideki Kaneko, Ikoma; Yoshifumi Moriya, Nara, all of Japan

[73] Assignee: Matsushita Electric Industrial Co., Ltd., Osaka, Japan

[21] Appl. No.: 264,652

[22] Filed: May 26, 1981

[30] Foreign Application Priority Data

Feb. 6, 1980 [JP] Japan ..... 55-74810
May 29, 1980 [JP] Japan ..... 55-72298

[51] Int. Cl.[3] ..... F23N 5/00

[52] U.S. Cl. ..... 431/78; 431/350; 431/355

[58] Field of Search ..... 431/76, 351, 352, 355, 431/78, 75, 350

[56] References Cited

U.S. PATENT DOCUMENTS 3,295,585 1/1967 Kovach et al. ..... 431/76
3,610,792 10/1971 Risse ..... 431/76
3,656,878 4/1972 Wright .
3,918,880 11/1975 Risse ..... 431/76 X
4,032,286 6/1977 Kobayashi et al. ..... 431/76
4,125,356 11/1978 Ohashi et al. ..... 431/76

FOREIGN PATENT DOCUMENTS 2418907 11/1979 France ..... 431/351
56-77607 6/1981 Japan ..... 431/351

*Primary Examiner*—Samuel Scott
*Assistant Examiner*—Margaret A. Focarino
*Attorney, Agent, or Firm*—Joseph W. Farley

[57] ABSTRACT

The present invention improves a conventional Bunsen burner by providing it with a primary combustion chamber which covers the primary flame forming portion of the Bunsen burner and which has a secondary flame hole immediately above the primary flame forming portion. The burner apparatus of the present invention produces reduced $NO_x$ since the overall combustion is divided into primary flame combustion and secondary flame combustion.

Further according to the invention, an indication of incomplete combustion due to oxygen deficiency in the ambient air or blockade of the primary air passage can be dependably detected for cessation of combustion by providing a flame rod and measuring the impedance (or ion current) of the rod.

1 Claim, 6 Drawing Figures

BURNER APPARATUS

Figure 1:
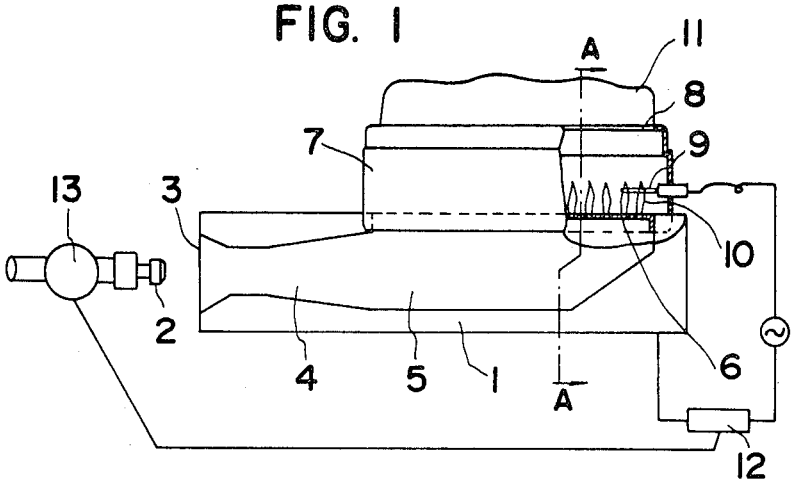

The present invention generally relates to a burner applicable to domestic combustors, particularly unventilated combustors, and it specifically refers to a low $NO_x$ burner which can be manufactured at low cost and which can reliably detect oxygen deficiency in the ambient air and blockade of the primary air supply.

Many of conventional domestic combustors employ therein a Bunsen burner and for this reason they exhibit a high $NO_x$ delivery of 100 to 150 ppm. Thus it is desired to lower the $NO_x$ delivery if the combustor is unventilated.

Some combustors employ an atmospheric pressure primary air burner, such as the Schwank burner, to assure reduced $NO_x$ emission for domestic use. However, such a combustor requires increased manufacturing cost as well as it involves difficulty in setting the TDR (turn down ratio) thereof high. Further it has another drawback that the projective area of its burning portion is invariably large. Thus its use is quite limited, for example, to gas heaters.

Industrial combustors, on the other hand, utilize various burning methods, such as two-stage combustion. In all these methods, air and fuel are forcibly mixed to adjust mixture ratio for controlled combustion. However such methods cannot be applied to domestic combustors because the combustors become large and require high production cost.

U.S. Pat. No. 3,656,878 discloses an apparatus for two-stage combustion in which air and fuel are independently supplied to the primary combustion zone to effect diffusion flame combustion. Such an apparatus however cannot be employed in domestic combustors since it necessitates forcibly feeding air as by a blower and since it is incapable of detecting the state of combustion through detecting variations in ambient oxygen concentration.

In domestic unventilated combustors it is desired to provide for the detection of incomplete combustion resulting from low oxygen concentration in the ambient air or the blockade of the primary air passage. For this purpose, various methods have been advocated, such as the sensor method utilizing a $ZrO_2$ sensor for sensing variations in oxygen concentration, the lift-up method using a pilot burner, or the flame rod method employing a flame ionization detector for detecting the ion current therethrough. In these methods, however, there is a possibility depending on the type of fuel used that the detection level is reached after incomplete combustion has initiated.

U.S. patent application Ser. No. 15,150 , now U.S. Pat. No. 4,315,729 discloses a system in which a pilot burner is employed to detect ambient oxygen concentration. The system however has the drawback that a main burner must be separately provided for heating purpose and that the blockade of the primary air passage for the main burner cannot be detected since the air passage for the main burner is different from that for the pilot burner. Further it is difficult in the system to properly set the combustion characteristics of the main and pilot burners and to lower $NO_x$ delivery of the main burner.

An object of the present invention is provide a low $NO_x$ burner apparatus which, by improving a conventional Bunsen burner, is applicable to domestic combustors and which can be manufactured at low cost.

In order to fulfill this object, the present invention provides a burner apparatus comprising:

a main burner body consisting of an inlet port disposed in front of a fuel injector for introducing fuel along with air, a diffuser portion arranged downstream from the inlet port for uniformly mixing the fuel and air, an equalizing portion arranged downstream from the diffuser portion for equalizing the pressure of the mixture, and a primary flame forming portion having a plurality of primary flame holes in communication with the equalizing portion, and primary combustion chamber provided with secondary flame hole means immediately above the primary flame forming portion.

According to a preferred embodiment of the invention, the apparatus further comprises a flame rod projecting into a primary flame or flames formed in the chamber through the flame forming portion, and a control circuit consisting of a detecting portion for detecting the ion current through the rod and a control portion for controlling combustion in cooperating relation with the detecting portion.

According to this embodiment, an indication of incomplete combustion due to low oxygen concentration or the blockade of the primary air passage can be dependably detected by the flame rod before the incomplete combustion will have started.

Figure 2:
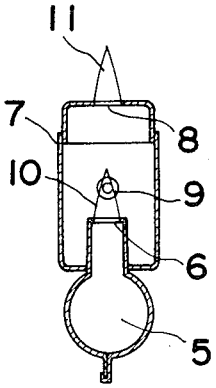
Figure 3:
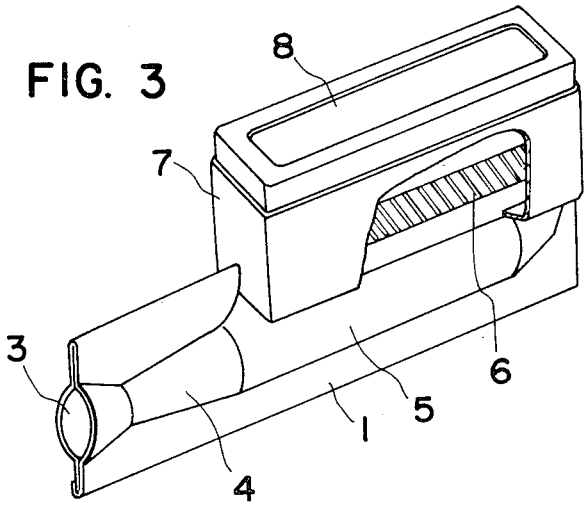
Figure 4:
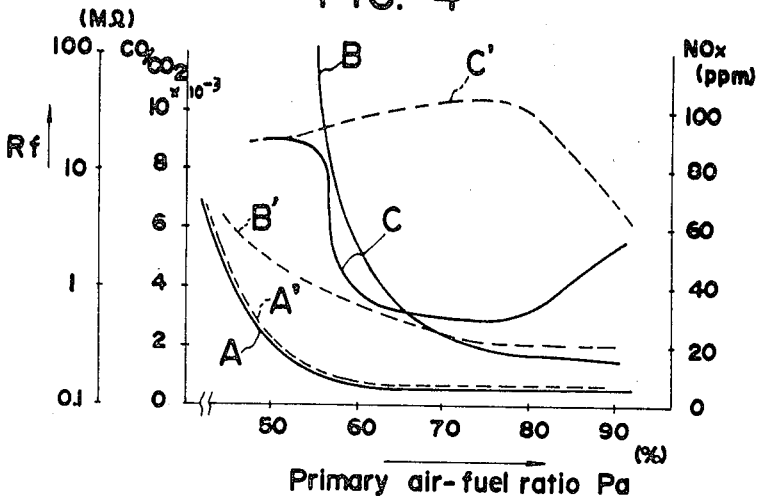
Figure 5:
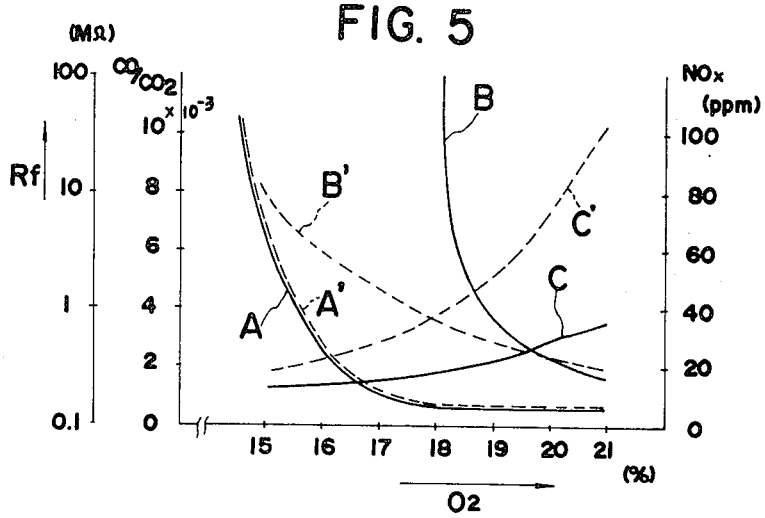
Figure 6:
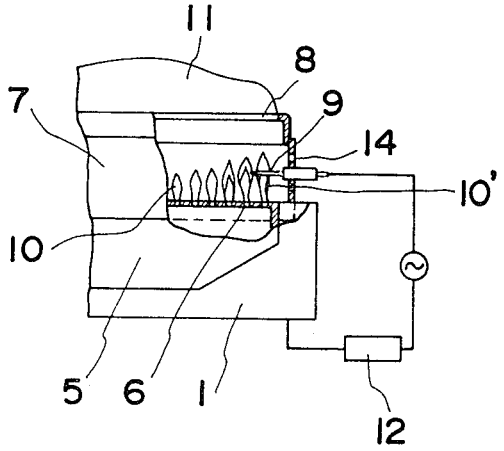

These and other features and effects of the present invention will be readily understood from the description of embodiments given with reference to the accompanying drawings, in which:

FIG. 1 is a side view partly in section of a low $NO_x$ burner apparatus embodying the invention, FIG. 2 is a sectional view taken along the line A—A in FIG. 1, FIG. 3 is a perspective view of the apparatus, FIGS. 4 and 5 are characteristic diagrams of the burner apparatus, and FIG. 6 is a side view partly in section of the principal portion of another burner apparatus embodying the invention.

Referring to FIGS. 1 to 3 showing a first embodiment, a main burner body 1 comprises an inlet port 3 arranged in facing relation to a fuel injector 2 for admitting fuel and air, a diffuser portion 4 for uniformly mixing the fuel and air, an equalizing portion 5 for equalizing the pressure of the mixture, and a primary flame forming portion 6 having a plurality of slit-shaped primary flame holes.

A primary combustion chamber 7 is provided on the main body 1 to cover the flame forming portion 6, and at the top of the chamber 7 is formed a secondary flame hole 8 (See FIG. 3) which has a larger opening area than the total opening area of the primary flame holes. Primary flames 10 are formed solely by primary air in the chamber 7 through the primary flame forming portion 6 as best illustrated in FIG. 2. A flame rod (flame ionization detector) 9 projects into some of the primary flames. The ambient air is supplied to the secondary flame hole 8 to generate a secondary flame 11 (FIG. 2).

A control circuit 12 comprises a detecting portion for detecting the ion current through the flame rod 9 in terms of impedance and a control portion for controlling the combustion. A valve 13 controls the fuel supply in cooperating relation with the control circuit 12.

In operation, a fuel leaving the injector 2 enters the inlet port 3 while entraining the surrounding air as primary air. Subsequently the fuel is uniformly mixed with the entrained air in the diffuser portion 4, and the mixture, after being rendered even in pressure in the equalizing portion 5, passes through the primary flame holes at uniform speed.

The mixture is ignited at the secondary flame hole 8 to form a flame. If the primary air ratio Pa (the ratio of the amount of primary air to the theoretical amount of air required for complete combustion) is higher than the lower limit of flamability, the flame thus formed returns to the primary flame forming portion 6 to form primary flames 10 which are sustained solely by the primary air.

In this state since the primary combustion is carried out in excess of the fuel, the fuel is decomposed to $H_2$, CO, CH and like gasses which are combined with oxygen in the ambient air around the secondary flame hole 8 to complete secondary combustion.

It should be appreciated that since the secondary flame hole 8 is provided in the form of a single port and has a larger opening area than the total opening area of the primary flame holes, the secondary flame will have a reduced temperature and the primary combustion chamber 7 will exhibit a low draft resistance to the primary air flow.

In FIGS. 4 and 5, various characteristics of the present apparatus are shown with the primary air ratio Pa and the ambient oxygen concentration respectively taken as the abscissas. In the graphs the curve A represents the $CO/CO_2$ characteristic; the curve B shows the impedance characteristic of the flame rod; and the curve C indicates the $NO_x$ characteristic. For comparison the corresponding curves A', B' and C' of a conventional Bunsen burner are also plotted.

It is seen from FIG. 4 that with the present apparatus the $NO_x$ delivery increases due to a rise in the temperature of the primary flame when the primary air ratio Pa is above 80%. Thus the amount of the primary air must be kept below 80% of the theoretical amount of air to reduce the $NO_x$ delivery.

On the other hand, if the primary air ratio Pa becomes below the lower limit of inflamability, the primary flames 10 will not be formed in the chamber 7, with the result that the overall combustion depends solely on the secondary combustion at the secondary flame hole 8. However the secondary combustion under this condition is accompanied by a Bunsen flame which delivers a high level of $NO_x$. Thus the primary air ratio Pa must be set above the lower limit of flamability.

According to the present invention, since the overall combustion is divided into the primary flame combustion using the primary air and the secondary flame combustion utilizing the secondary air under the condition of lower flamability limit <the primary air ratio Pa<80% the temperature of each flame is much lower than that of a conventional Bunsen burner. As a result, the $NO_x$ delivery of the present apparatus can be lowered up to about $\frac{1}{3}$ of that of a Bunsen burner.

When the primary air passage provided by the members 3, 4 and 5 clogs up to lower the primary air ratio Pa past the lower inflamability limit, the primary flames 10 are lifted up to form a Bunsen flame at the hole 8, with the result that the overall combustion depends solely on the secondary combustion. At this time the impedance of the flame rod 9 increases drastically from several hundred KΩ to infinity as shown by the curve B in FIG. 4.

The $CO/CO_2$ ratio, on the other hand, begins to rise at a Pa value lower than the lower inflamability limit as indicated by the curve A. Therefore by detecting the drastic rise in the impedance which occurs before the rise in the $CO/CO_2$ ratio, possible blockade of the primary air passage can be dependably detected.

In the case of a conventional Bunsen burner, the overall flame comprises an inner primary flame and an outer secondary flame enclosing the primary flame. Therefore even if the primary air passage is plugged to reduce the primary air supply, the overall flame is sustained by the ambient secondary air. Thus the overall flame would reluctantly lift up, with the result that the impedance of the flame rod alters gently as indicated by the curve B', making it difficult to detect the blockade of the primary air passage.

The present invention completely eliminates such a difficulty and provides a high safety burner apparatus which can positively sense the blockade of the primary air passage.

Further according to the present invention, if the oxygen concentration of the ambient air drops to 18%–19% to lower the primary air ratio Pa below the lower inflamability limit, the primary flames 10 are lifted up into the secondary flame 11. With the lift-up of the primary flames the impedance of the flame rod 9 rises from several hundred KΩ to infinity as indicated by the curve B in FIG. 5. The secondary combustion under this condition is maintained by the so-called Bunsen flame, thanks to which a rise in the $CO/CO_2$ ratio occurs at a still lower oxygen concentration ($O_2 \approx 15\%$) as shown by the curve A.

With the conventional Bunsen burner, conversely, the impendance varies mildly with reduction in the oxygen concentration as indicated by the curve B', and the $CO/CO_2$ characteristic slightly deteriorates. Thus the safety device for the Bunsen burner may operate after a rise in the $CO/CO_2$ curve. The present invention completely eliminates such a problem and provides a burner apparatus which can reliably detect reduction in the oxygen concentration before a rise in the $CO/CO_2$ ratio.

It is to be noted here that since the temperatures of the primary and secondary flames fall with reduction in the $O_2$ concentration, the $NO_x$ delivery tends to reduce with reduction in the $O_2$ concentration. Thus there is no problem with respect to the $NO_x$ emission.

It is further to be noted that the same detection effect as above can be achieved by measuring the ion current through the flame rod in stead of the impedance of the rod since the impedance is in a specific relation to the ion current.

Referring to FIG. 6 showing another embodiment of the present invention, the primary combustion chamber 7 is provided with auxiliary ventilation holes 14 around the flame rod 9. Auxiliary air supplied through the auxiliary holes 14 intensifies primary flames 10' adjacent the rod 9 to increase the ion current through the rod 9. As a consequence, the impedance curves B in FIGS. 4 and 5 shift leftward; that is, toward the lower Pa and $O_2$ concentration sides.

As seen in FIG. 5, there is a rather large gap between the oxygen concentration (18–19%) at which a sharp rise in the impedance is detected and that (14–15%) at which a rise in the $CO/CO_2$ ratio is observed. The aforementioned auxiliary holes 14 serve to translate the detection oxygen concentration toward the lower $O_2$ concentration side, for example from 18–19% to 17–18%. The same discussion holds true with FIG. 4.

Thus the second embodiment provides a stabilized safety means free of premature detection.

What is claimed is:

1. A burner apparatus for use as a main burner for heating purpose comprising:

a main burner body comprising an inlet port disposed in opposed relation to a fuel injector for introducing fuel along with air, a diffuser portion arranged downstream from the inlet port for uniformly mixing the fuel and air, an equalizing portion arranged downstream from the diffuser portion for equalizing the pressure of the air-fuel mixture, and a primary flame forming portion having a plurality of slit-like primary flame holes in communication with the equalizing portion, a primary combustion chamber provided, immediately above the primary flame holes, with a single secondary flame hole having a larger opening area than the total opening area of the primary flame holes, a flame rod projecting into a primary flame or flames formed in the chamber through the primary flame forming portion, the primary combustion chamber being provided with at least one auxiliary ventilation port adjacent the flame rod for supplying auxiliary air to a primary flame or flames formed adjacent the flame rod, and a control circuit comprising a detecting portion for detecting the ion current through the rod and a control portion for controlling combustion in cooperating relation to the detecting portion.

* * * * *